United States Patent [19]

Lim

[11] Patent Number: 4,750,096

[45] Date of Patent: Jun. 7, 1988

[54] FLUORESCENT LIGHT FIXTURE

[75] Inventor: Kenneth Lim, Piedmont, Calif.

[73] Assignee: Lumatech Corp., Oakland, Calif.

[21] Appl. No.: 3,183

[22] Filed: Jan. 13, 1987

[51] Int. Cl.[4] ..... F21S 2/00

[52] U.S. Cl. ..... 362/218; 362/260; 362/294

[58] Field of Search ..... 362/218, 294, 260, 222, 362/264, 310, 373

[56] References Cited

U.S. PATENT DOCUMENTS

| | | | |
|---|---|---|---|
| 3,364,346 | 1/1968 | Gunn | 362/264 |
| 3,705,302 | 12/1972 | Judge et al. | 362/222 |
| 3,895,227 | 7/1975 | Murray et al. | 362/294 |
| 4,363,083 | 12/1982 | Tanaka et al. | 362/373 |
| 4,497,016 | 1/1985 | Sachse | 362/294 |
| 4,503,360 | 3/1985 | Bedel | 362/373 |
| 4,507,719 | 3/1985 | Quiogue | 362/218 |
| 4,520,436 | 5/1985 | McNair et al. | 362/260 |
| 4,563,729 | 1/1986 | Jendrewski | 362/218 |

FOREIGN PATENT DOCUMENTS

| | | | |
|---|---|---|---|
| 0128566 | 10/1981 | Japan | 362/218 |

*Primary Examiner*—Charles J. Myhre
*Assistant Examiner*—David A. Okonsky
*Attorney, Agent, or Firm*—Bielen & Peterson

[57] ABSTRACT

A fluorescent light fixture which employs a lamp fitting, electrical ballast, and a base which are inter linked, to mechanically and electrically, to connect to a fluorescent lamp to an electrical socket. A heat conductive housing and a spacer mechanism transport heat from the ballast to the exterior of the lighting fixture when the same is in operation.

9 Claims, 2 Drawing Sheets

FLUORESCENT LIGHT FIXTURE

BACKGROUND OF THE INVENTION

The present invention relates to a novel fluorescent light fixture which may be screwed into a conventional light socket in substitution for an incandescent light bulb.

Standard incandescent light bulbs are typically rated between 40 watts and 150 watts. Each incandescent bulb includes an "Edison" base which screws into a conventional light bulb socket. The standard incandescent lamp lasts about 1000 hours. It has long been realized that fluorescent lighting consumes far less electricity to produce lighting levels which are equivalent to incandescent bulbs. In the past, fluorescent lighting has been restricted to custom fluorescent fixtures which are typically 2 feet by 4 feet and employ bulbs approximately 4 feet in length. These fluorescent lighting fixtures must be specially installed and are, thus, incompatible with the standard screw-in light socket employed by standard incandescent light bulbs.

A recent development in fluorescent lighting has resulted in the production of a PL fluorescent lamp. In general, the PL lamp is a U-shaped lamp having a starter built into the base portion thereof. Generally, the PL fluorescent lamp is measured in wattages ranging from 4 watts to 13 watts, which generally correspond to the 40–150 watt level of the standard incandescent light bulb. Also, the PL fluorescent lamp has a lamp life of about 10,000 hours compared to the 1000 hours of the standard incandescent light bulb, previously noted.

Early fluorescent light fixtures such as model 2000, 3000-9 and 3013 manufactured under the trademark Refluor and the Reflect-A-Star manufactured by Lumatech Corporation of Oakland, Calif. employed in PL lamp in a body having an external, plug-in ballast. In some cases a replaceable starter was also provided. Although the PL lamp did perform satisfactorily in producing required lighting levels, the plug-in components prevented the lamps in being used in certain lighting fixtures such as down lights, recessed lights and the like.

A fluorescent light fixture which employs a fluorescent lamp, has a slim configuration, and is capable of dissipating heat generated by an internally located ballast would be great advance in the field of lighting.

SUMMARY OF THE INVENTION

In accordance with the present invention a novel and useful fluorescent light fixture which overcomes many of the disadvantages in the prior art is herein provided.

The fluorescent light fixture, or unit, of the present invention utilizes a fitting for mechanically holding the lamp. The lamp, which is a standard PL type florescent lamp, is also electrically linked to the same. An electrical ballast is positioned relative to the fitting and is, likewise, electrically linked to the same. Thus, the electrical ballast controls the fluorescent lamp being used. A base member is positioned adjacent the ballast and includes means for mechanically and electrically connecting the ballast to a standard electrical, screw-in, light socket.

A housing is also provided in the present fixture which is heat conductive and possesses interior and exterior surfaces. Means is included for transporting heat generated by the ballast to the interior surface of the housing. The heat transportation means may take the form of at least one heat conductive spacer interposed and contacting the ballast and the interior surface of the housing. If the housing interior surface is rounded, the spacer would include a rounded surface which is intended to contact the rounded interior surface of the housing. In addition, the spacer may be constructed with a flat surface to contact a flat surface of the ballast. Thus, heat may be transported from the ballast to the spacer and finally to the heat conductive housing for dissipation to the ambient environment. In this regard, the housing exterior surface may include one or more fins to aid in the dissipation of the heat conducted thereto.

The light fixture of the present application also includes a reflector to direct light originating from the fluorescent lamp to the area being lighted. The reflector includes a specular surface of curved configuration, shaped generally in the form of a "drip" curve. The sectional configuration of such a reflector is determined by projecting a first circular image of the fluorescent lamp laterally and behind the theoretical specular reflecting surface i.e. opposite to the direction of the object being illuminated. A first point is determined by an arc having a radius of a diameter of the first circular image and a pair of lines equidistant between the source and a first circular image. A series of circular images of equal diameter to the first circular image are then extended along a line perpendicular to the axis of the lamp, with each one determining the subsequent point in the specular reflecting surface. A continuous smooth curve is then drawn through the multiplicity of points so determined, which represents the curvature of the specular surface of the reflector.

It may be apparent that a novel and useful fluorescent fixture has been hereabove described.

It is therefore an object of the present invention to provide a fluorescent light fixture which is of a slim configuration and is adaptable to being fitted within a standard screw-in incandescent light socket.

It is another object of the invention to provide a fluorescent light fixture which efficiently dissipates heat generated by an internally located fluorescent ballast.

Another object of the present invention is to provide a fluorescent light fixture which possesses a reflector which maximizes lighting levels along the optical access thereof and immediately adjacent to the same.

Another object of the present invention is to provide a fluorescent light fixture which may be used in indoor or outdoor environments.

The invention possesses other objects and advantages especially as concerns particular characteristics and features thereof which will become apparent as the specification continues.

For a better understanding of the invention reference is made to the following detailed description of the preferred embodiments thereof which should be referenced to the hereinabove described drawings.

DESCRIPTION OF THE PREFERRED EMBODIMENTS

Various aspects of the present invention will evolve from the following detailed description of the preferred embodiments which should be referenced to the hereinabove drawings.

Figure 1:
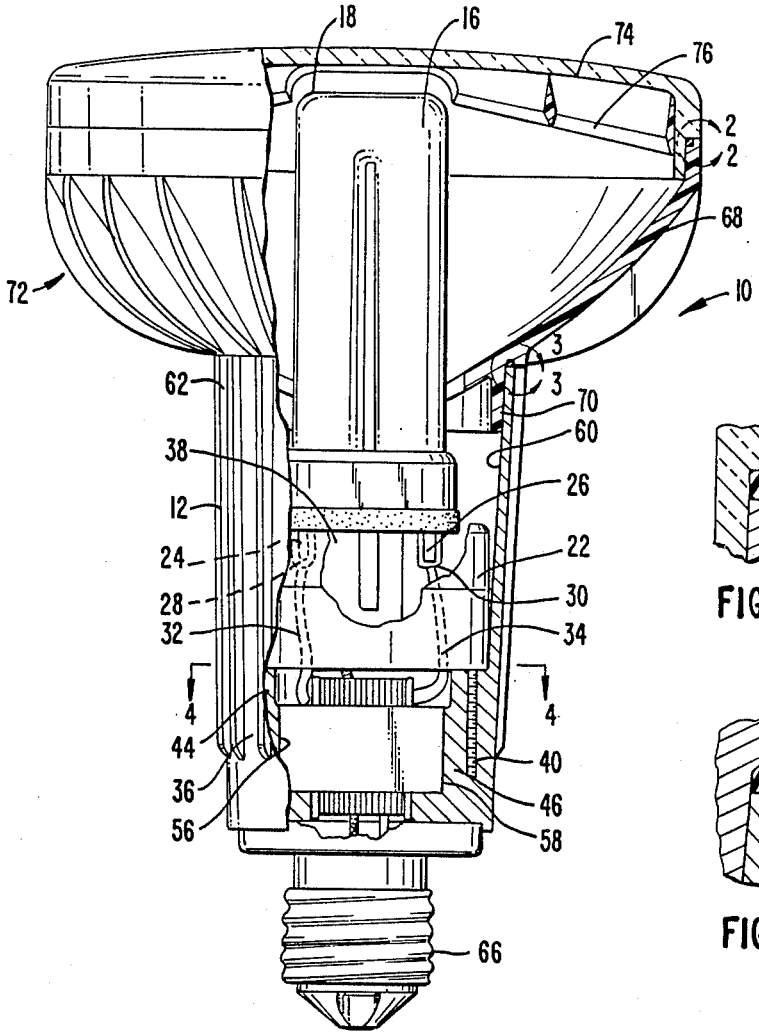
FIG. 1 is a side elevational view of the fluorescent light fixture having a portion cut away.
Figure 4:
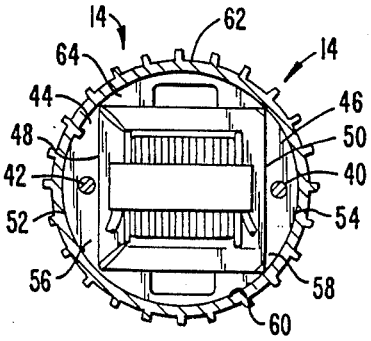
FIG. 4 is a sectional view taken along line 4—4 of FIG. 1.

The invention as a whole is shown in the drawings by reference character 10. The fluorescent lighting fixture or unit 10 includes as one of its element a housing 12 which is constructed of heat conductive material such as aluminum, steel, and the like. Housing 12 is generally in the shape of a truncated cone and includes a plurality of fins 14 spaced circumferentially, FIGS. 1 and 4. Fins 14 aid in the dissipation of heat from the interior of housing 12 which will be described hereinafter.

Unit 10 is intended to employ a standard PL lamp such as a twin lamp manufactured by Sylvania of Danvers, Mass. PL lamps are generally rated by wattages, varying from 5 to 14 watts, in most cases. The lamp 16, depicted in the drawings is a 5 watt PL lamp, although the invention is not deemed to be limited to the employment of a PL lamp of this wattage. Lamp 16 includes a u-shaped envelope 18 and a support 20. Light emanates from glass envelope 18 while support 20 provides the mechanical and electrical connection of lamp 16 to fitting 22. Prongs 24 and 26 of lamp 16 engage electrical contacts 28 and 30 with fitting 22, respectively. Wires 32 and 34 connect to contacts 28 and 30, respectively, and lead to ballast 36 within housing 12. Plug 38 of lamp 16 mechanically holds lamp 16 to fitting 22. Fitting 22 is itself fixed to housing 12 by screws 40 and 42.

Ballast 36 is a standard iron core ballast normally employed with PL lamp 16. Housing 22 includes the provision of a pair of spacers 44 and 46 which are integrally formed within the truncated conical portion of housing 12. It should be noted that spacers 44 and 46 may be separately formed, but position in intimate contact with the truncated conical portion of housing 12. Screws 40 and 42 threadingly engage spacers 44 and 46, respectively. Spacers 44 and 46 include flattened portions 48 and 50 and rounded portions 52 and 54, respectively. Flattened portion 48 and 50 contact the sides 56 and 58 of ballast 36. Rounded portions 52 and 54 of spacers 44 and 46 are in heat conductive relationship with the truncated section of housing 12, since they are integrally formed therewith. Spacers 44 and 46 are constructed of heat conductive material. Thus, any heat generated by ballast 36 is easily transferred by conduction to the interior surface of housing 12, through housing 12, and to the exterior surface of housing 12. Plurality of fins 14 aid in the dissipation of heat to the ambient environment which is normally air.

Ballast 36 is thus sandwiched between fitting 22 and bottom 64 of housing 12. Electrical linkage from ballast 36 extends to "Edison" base 66 which screws into a standard light socket commonly used by incandescent light bulbs.

Reflector 68 press fits into the upper portion of housing 12 by the use of a collar 70. The exterior of reflector 68 includes a plurality of fins 72 which may be aligned with a plurality of fins 14 on the exterior surface 62 of housing 12. However, plurality of fins 72 do not necessarily dissipate heat. In fact, in the embodiment shown in FIGS. 1–6, reflector 68 and fins 72 are constructed of plastic material and, thus, possesses an insulative quality. Lens 74 of transparent material press fits into the outer portion of reflector 68. Lens 74 is readily removable from reflector 68. Louver or baffle 76 may be employed to prevent the lateral distribution of light from unit 10 i.e. a glare cutoff mechanism.

Figure 2:
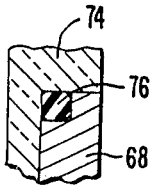
FIG. 2 is a sectional view taken along line 2—2 of FIG. 1.
Figure 3:
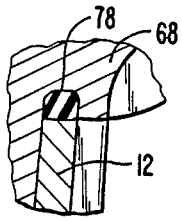
FIG. 3 is a sectional view taken along line 3—3 of FIG. 1.

Turning to FIGS. 2 and 3 it may be seen that o-rings or gaskets 76 and 78 may be placed between lens 74 and reflector 68 and housing 12, respectively. Gaskets 76 and 78 render unit 10 as a rainproof or waterproof fixture, suitable for outdoor usage.

Figure 5:
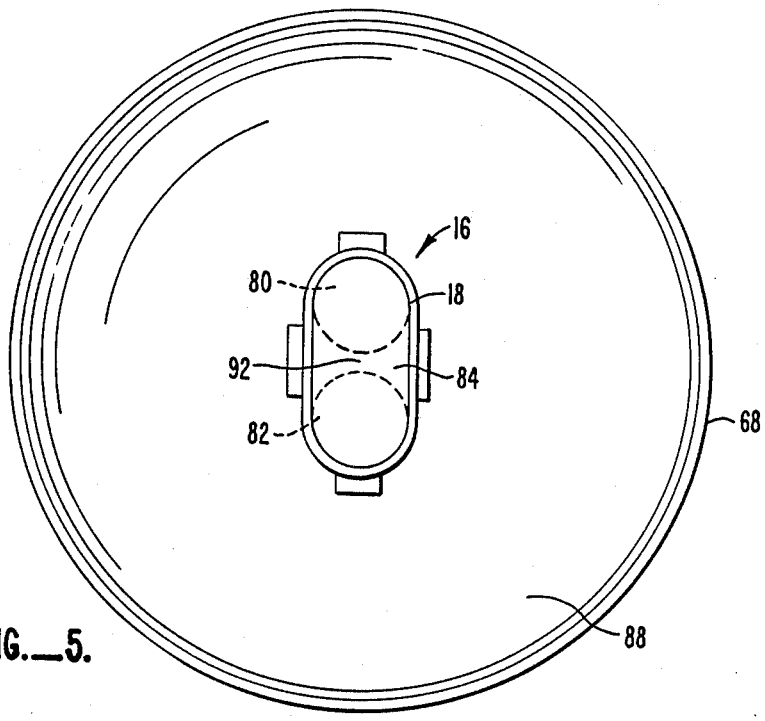
FIG. 5 is a top plan view of the fluorescent light fixture having the lens portion removed.
Figure 6:
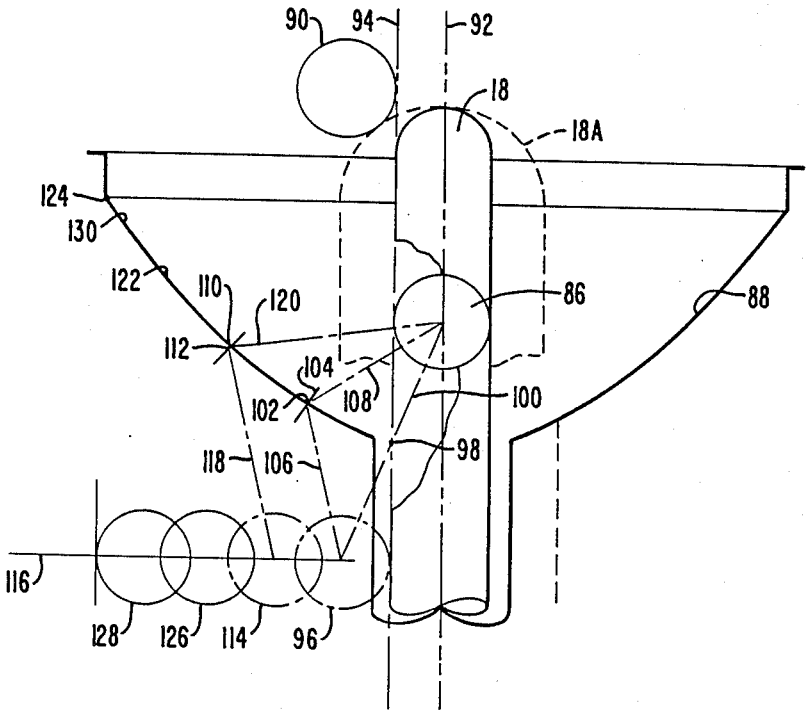
FIG. 6 is a schematic view representing the sectional configuration of the reflector of the fluorescent light fixture of the present invention.

Reflector 68 is shown in greater detail on FIGS. 5 and 6. Lamp 16 possesses tubes 80 and 82 which extend downwardly from upper connecting portion 84. Although the shape of PL lamp 16 is different than a incandescent bulb, a representation of the source of light emanating from lamp 16 may take the form of a circle 86 depicted in FIG. 6. Reflector 68 includes a specular surface 88 which possesses a concave shape close to a "drip" shaped curve, in section. That is, the curve formed by a string of uniform density fastened at both ends and pulled downwardly in the center only by the force of gravity. With reference to FIG. 6 it may be seen that lamp envelope 18 is shown on end, schematically, and rotated 90 degrees, in phantom. Also, reflector 68 and specular surface 88 are shown schematically in section.

The curvature of reflector 68 has been determined by producing an image 90 of circular configuration and having the same diameter as source representation 86. The center of image 90 is displaced laterally from optical axis 92 a distance equal to its diameter. In other words, a line 94 tangent to image 90 and source representation 86 would also be parallel to optical axis 92. Image 90 is also displaced vertically to lie tangent to the theoretical revolution 18A of envelope 18 about axis 92, depicted in phantom in FIGS. 6. First virtual image 96 is oriented relative to source representation 86 along line 94 and in a direction opposite to the intended direction of light being projected from reflector 68. A first point 98 is determined as the intersection of line 94 and line 100 connecting the centers of first circular, virtual image 96 and source representation 86. A second point 102 is determined as being the arc of a circle equal to the diameter of source representation 86 and employing point 98 as the center of the arc of the circle. Arc 104 is intersected by lines 106 and 108, which are of equal length and emanate from the centers of virtual image 96 and source representation 86. A third point 110 is determined as a arc of a circle of diameter of source representation 86 using point 102 as the center of the circle of such an arc 112. A second virtual image 114 is displaced laterally relative to lamp 16 and along a line 116 which is essentially parallel to a plane perpendicular to optical axis 92. Lines 118 and 120 of equal length connect the center of source representation 86 and second virtual image 114 and intersect arc 112. Points 122 and 124 are similarly obtained forming images 126 and 128 in conjunction with source representation 86. A smooth curve 130 is used to connect points 98, 102, 110, 122, and 124. Curve 130 represents the curvature of specular surface 88 of reflector 68, in section. It has been found that specular surface 88 delivers a highly concentrated light projection directly above the unit fixture 10 at a small radius about a point formed where axis 92 intersects the surface to be lighted. Specular surface 88 is particularly useful for recessed downlights.

In operation, unit 12 is screwed into a standard incandescent light socket employing "Edison" base 66. Light from lamp 16 will be projected downwardly or outwardly, as the case may be, by the use of reflector 68 in a "flood" configuration. Any heat generated by ballast 36 will be transferred to the exterior surface 62 of housing 12 by the use of spacers 44 and 46. Unit or fixture 10 generally possess a life which is 10 times longer than a comparable incandescent bulb. Unit 12 is depicted as using 5 watt fluorescent PL lamp and has been determined to satisfactorily replace a 40 watt incandescent bulb. Also, reflector 68 efficiently projects light from lamp 16 to the extent that a five watt fluorescent PL lamp may be substituted for a 7 watt PL lamp without reflector 68. It has also been determined that the operating cost of unit 10 is one seventh that of an incandescent bulb, and delivers equivalent lighting levels. Moreover, there is a great savings in labor cost expended in the replacement of burned out lamps.

While in the foregoing embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A fluorescent light fixture for mounting a fluorescent lamp to an electrical light socket to be employed for illumination of an object comprising:

a. a fitting for mechanically holding the lamp, said fitting being electrically linked to the lamp;

b. an electrical ballast, said ballast being positioned relative to said fitting and being electrically linked to said fitting;

c. a base, said base being positioned adjacent said ballast, said base including means for mechanically and electrically connecting said base to the electrical light socket;

d. a heat conductive housing enclosing said fitting and ballast, said housing having an interior surface and an exterior surface;

e. means for conducting heat generated by said ballast therefrom and to the interior surface of said housing, said heat transporting means including at least one heat conductive spacer interposed and contacting said ballast and said interior surface of said housing.

2. The fluorescent light fixture of claim 1 in which said exterior surface of said housing includes at least one fin for dissipating heat conducted to said outer surface of said housing from said ballast.

3. The fluorescent light fixture of claim 1 in which said housing interior surface of said housing includes a rounded portion, said ballast includes a flat surface, and said spacer includes a rounded surface and a flat surface, said spacer rounded and flat surfaces contacting said rounded portion of said housing interior surface and said flat surface of said ballast, respectively.

4. The fluorescent light fixture of claim 1 which further comprises a reflector positioned a sufficient distance from the fluorescent lamp to reflect light therefrom.

5. The fluorescent light fixture of claim 4 which further includes a lens placed over said reflector.

6. The fluorescent light fixtures of claim 5 which further includes a lower placed adjacent said lens for selectively blocking light originating from the fluorescent lamp.

7. The fluorescent light fixture of claim 6 in which said exterior surface of said housing includes at least one fin for dissipating heat conducted to said outer surface of said housing from said ballast.

8. The fluorescent light fixture of claim 7 in which said housing interior surface of said housing includes a rounded portion said ballast includes a flat surface, and said spacer includes a rounded surface and a flat surface, said spacer rounded and flat surfaces contacting said rounded portion of said housing interior surface and said flat surface of said ballast, respectively.

9. The fluorescent light fixture of claim 4 in which said reflector is of a curved sectional configuration determined by establishing a circular configuration of the light source of the fluorescent lamp establishing a representative first circular image of identical diameter to said circular source, representation, said first circular image being displaced from said circular source representation and away from the object being illuminated; determining a first point as the intersection of a first line tangent to said circular source configuration and said first circular image; determining a second point as the intersection of a first arc of a circle of the diameter of said circular image and employing said first point as the center and a first pair of lens of equal length intersecting said first arc of a circle one of said first pair of lines emanating from the center of said first circular image and the other of said first pair of lines emanating from the center of said circular source representation; determining a third point as the intersection of a second arc of circle of the diameter of said first circular image and employing said second point as the center, and a second pair of lines of equal length intersecting said second arc of a circle, one of said second pair of lines emanating from the center of said circular source representation and the other of said second pair of lines emanating from the center of a second circular, image of identical diameter to said circular source representation, and connecting said first second and third points with a smooth continuous curve.

* * * * *